US009869210B2

(12) United States Patent
Jouanno et al.

(10) Patent No.: US 9,869,210 B2
(45) Date of Patent: Jan. 16, 2018

(54) CAM FOLLOWER, INJECTION PUMP AND VALVE ACTUATOR COMPRISING SUCH A CAM FOLLOWER, AND MANUFACTURING METHOD

(71) Applicants: Guillaume Jouanno, Plouha (FR); Nicolas Berruet, Artannes sur Indre (FR); François Champalou, Chaumont-sur-Loire (FR); Benoît Hauvespre, Saint Etienne de Chigney (FR); Samuel Viault, Saint-Antoine-du-Rocher (FR)

(72) Inventors: Guillaume Jouanno, Plouha (FR); Nicolas Berruet, Artannes sur Indre (FR); François Champalou, Chaumont-sur-Loire (FR); Benoît Hauvespre, Saint Etienne de Chigney (FR); Samuel Viault, Saint-Antoine-du-Rocher (FR)

(73) Assignee: AKTIEBOLAGET SKF, Gothenburg (SE)

( * ) Notice: Subject to any disclaimer, the term of this patent is extended or adjusted under 35 U.S.C. 154(b) by 8 days.

(21) Appl. No.: 15/133,876

(22) Filed: Apr. 20, 2016

(65) Prior Publication Data

US 2016/0312665 A1 Oct. 27, 2016

(30) Foreign Application Priority Data

Apr. 23, 2015 (EP) ..... 15305617

(51) Int. Cl.
*F01L 1/18* (2006.01)
*F01L 1/16* (2006.01)
(Continued)

(52) U.S. Cl.
CPC ..... *F01L 1/16* (2013.01); *F01L 1/14* (2013.01); *F02M 59/102* (2013.01);
(Continued)

(58) Field of Classification Search
CPC ..... F01L 1/16; F01L 2101/00; F01L 2103/00; F01L 1/14; F01L 2105/00; F01L 2107/00;
(Continued)

(56) References Cited

U.S. PATENT DOCUMENTS 5,239,951 A 8/1993 Rao et al.
6,451,890 B1 * 9/2002 Imashiro ..... C08K 3/16 524/195
(Continued)

FOREIGN PATENT DOCUMENTS

DE 10251198 A1 5/2004
DE 102009058369 A1 7/2010
(Continued)

*Primary Examiner* — Zelalem Eshete
(74) *Attorney, Agent, or Firm* — Bryan Peckjian; SKF USA Inc. Patent Dept.

(57) ABSTRACT

The invention concerns a cam follower providing a tappet having a cylindrical outer surface centered on a longitudinal axis (Y1) and adapted to slide in a housing surrounding the tappet, a pin extending between two opposite ends along a transverse axis (X1) perpendicular to the longitudinal axis, and a roller element movable in rotation relative to the pin around the transverse axis and adapted to roll on a cam. The tappet is made of a composite material integrating at least one dry lubricant released at the cylindrical outer surface when the cam follower is in operation. The invention also concerns a valve actuator for a motor vehicle, providing such a cam follower. The invention also concerns a method for manufacturing such a cam follower.

10 Claims, 2 Drawing Sheets

(51) Int. Cl.
*F02M 59/10* (2006.01)
*F02M 59/44* (2006.01)
*F01L 1/14* (2006.01)

(52) U.S. Cl.
CPC ..... *F02M 59/445* (2013.01); *F01L 2101/00* (2013.01); *F01L 2103/00* (2013.01); *F01L 2105/00* (2013.01); *F01L 2107/00* (2013.01); *F01L 2810/02* (2013.01); *F02M 2200/9015* (2013.01)

(58) Field of Classification Search
CPC . F01L 2810/02; F02M 59/102; F02M 59/445; F02M 2200/9015
See application file for complete search history.

(56) References Cited

U.S. PATENT DOCUMENTS

| | | | | |
|---|---|---|---|---|
| 8,201,532 | B2 * | 6/2012 | Prokop | F01L 1/14 123/90.5 |
| 2011/0285489 | A1 * | 11/2011 | Rinella | H01F 7/0231 335/306 |
| 2014/0165825 | A1 | 6/2014 | Tibari et al. | |

FOREIGN PATENT DOCUMENTS

| | | | |
|---|---|---|---|
| EP | 2607636 | A1 | 6/2013 |
| EP | 2853696 | A1 | 4/2015 |

* cited by examiner

CAM FOLLOWER, INJECTION PUMP AND VALVE ACTUATOR COMPRISING SUCH A CAM FOLLOWER, AND MANUFACTURING METHOD

CROSS-REFERENCE TO RELATED APPLICATIONS

This application claims priority to European patent application No. 15305617.1 filed on Mar. 23, 2015, the contents of which are fully incorporated herein by reference.

TECHNICAL FIELD OF THE INVENTION

The invention concerns a cam follower. The invention also concerns an injection pump and a valve actuator for a motor vehicle, each comprising such a cam follower. The invention also concerns a method for manufacturing such a cam follower.

BACKGROUND OF THE INVENTION

EP-A-2 607 636 discloses a cam follower comprising a tappet, a pin and a roller. The tappet extends along a longitudinal axis, while the pin and the roller are centered on a transverse axis. The tappet is formed with two lateral flanges, delimiting an intermediate gap between them and each comprising a cylindrical bore. The roller is positioned in the intermediate gap between both flanges and bores. The pin is fitted in the two bores, such that the roller is movable in rotation relative to the pin around its axis. The pin is caulked, in other words plastically deformed, on both opposite ends to create a mechanical connection by press-fit in the tappet bores.

When the cam follower is in service, the roller collaborates with a cam synchronized with the internal combustion engine camshaft. The rotation of the camshaft leads to a periodic displacement of a piston of the pump that rests against the tappet, to allow fuel to be delivered. The tappet is movable back and forth along the longitudinal axis in a housing, while the roller is movable in rotation around its central axis against the cam.

Classically, the tappet can be made of a polymer material. However, under high temperatures and humidity of cam follower applications, polymer materials induce problems of dimensional stability and moisture absorption. The tappet dimensions and tolerances in the housing can change, which create a risk of failure of the cam follower, and consequently a risk of failure of the engine.

SUMMARY OF THE INVENTION

The aim of the invention is to provide an improved cam follower.

To this end, the invention concerns a cam follower comprising a tappet having a cylindrical outer surface centered on a longitudinal axis and adapted to slide in a housing surrounding the tappet, a pin extending between two opposite ends along a transverse axis perpendicular to the longitudinal axis and a roller element movable in rotation relative to the pin around the transverse axis and adapted to roll on a cam. According to the invention, the tappet is made of a composite material integrating at least one dry lubricant released at the cylindrical outer surface when the cam follower is in operation.

Thanks to the invention, wear of the tappet moving back and forth in its housing can be reduced. Consequently, lifetime of the cam follower can be improved. Dry lubricant contained in the tappet provides a satisfactory lubrication of its tappet outer diameter in addition to the engine oil.

According to further aspects of the invention which are advantageous but not compulsory, such a cam follower may incorporate one or several of the following features:

- The tappet comprises a synthetic matrix, for example made of polyamide (PA), polyphtalamide (PPA), polyether-ether-ketone (PEEK) or polyaryletherketone (PAEK).
- The tappet comprises reinforcement fibers, by example glass fibers, carbon fibers or para-aramid synthetic fibers.
- The reinforcement fibers and the at least one dry lubricant constitute between 28 and 32% in weight of the tappet.
- The at least one dry lubricant integrated to the tappet is chosen among graphite, polytetrafluoroethylene (PTFE) and molybdenum disulfide (MoS2).
- The tappet is made of a composite material integrating two dry lubricants, by example graphite and polytetrafluoroethylene.
- The cam follower is provided with at least one antirotation device for preventing rotation of the tappet in the housing around the longitudinal axis.
- The cam follower further comprises a support element mounted in the tappet and supporting the pin.
- The support element is fitted in recesses formed in the tappet.
- Each pin end is mounted between a half-cylindrical section formed in the tappet and a half-cylindrical section formed in the support element.
- The support element is a metal insert, for example made of steel.
- The cam follower comprises a bearing interposed between the pin and the roller element.

The invention also concerns an injection pump for a motor vehicle, comprising a cam follower as defined here-above.

The invention also concerns a valve actuator for a motor vehicle, comprising a cam follower as defined here-above.

The invention also concerns a method for manufacturing a cam follower as described here-above, whereas the method comprises a step of forming the tappet of a composite material integrating at least one dry lubricant adapted to be released at the cylindrical outer surface when the cam follower is in operation.

BRIEF DESCRIPTION OF THE DRAWINGS

The invention will now be explained in correspondence with the annexed figures, and as an illustrative example, without restricting the object of the invention. In the annexed figures.

DETAILED DESCRIPTION OF THE INVENTION

Figure 2:
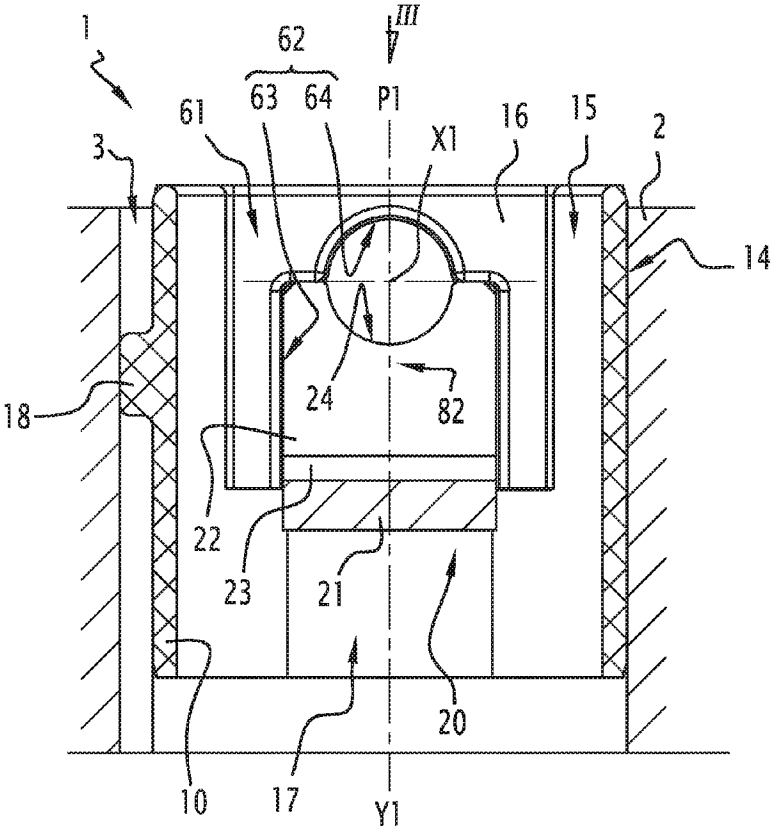
- FIG. 2 is a second sectional view of the cam follower, in a second plane perpendicular to the first plane and including the longitudinal axis of the cam follower, showing only the tappet and the insert.
Figure 1:
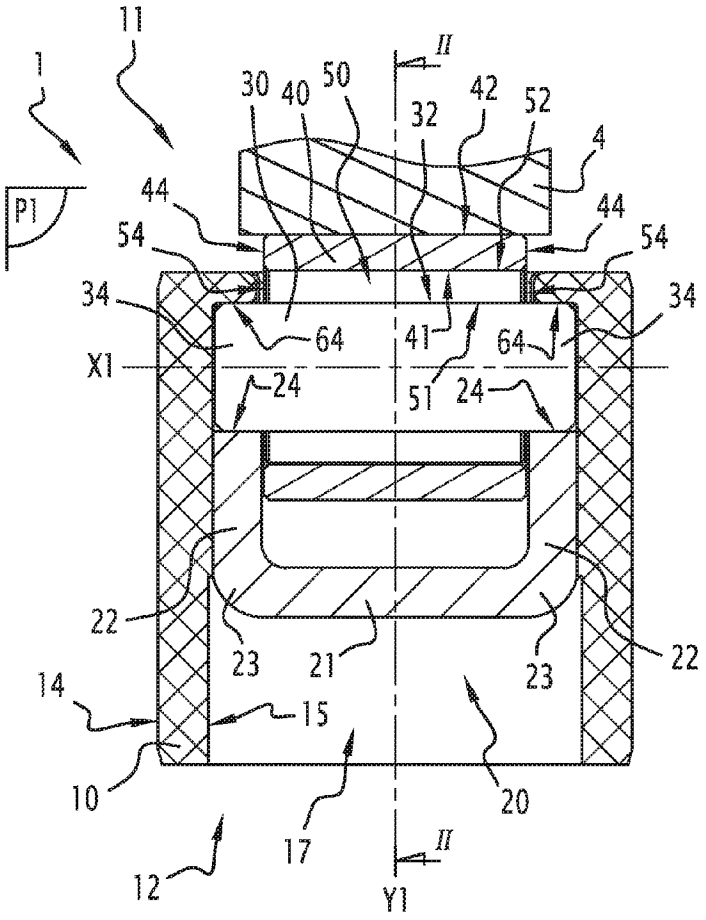
- FIG. 1 is a first sectional view of a cam follower according to the invention, in a first plane including the longitudinal axis of the cam follower, showing a tappet, an insert, a pin and a roller forming the cam follower.
Figure 4:
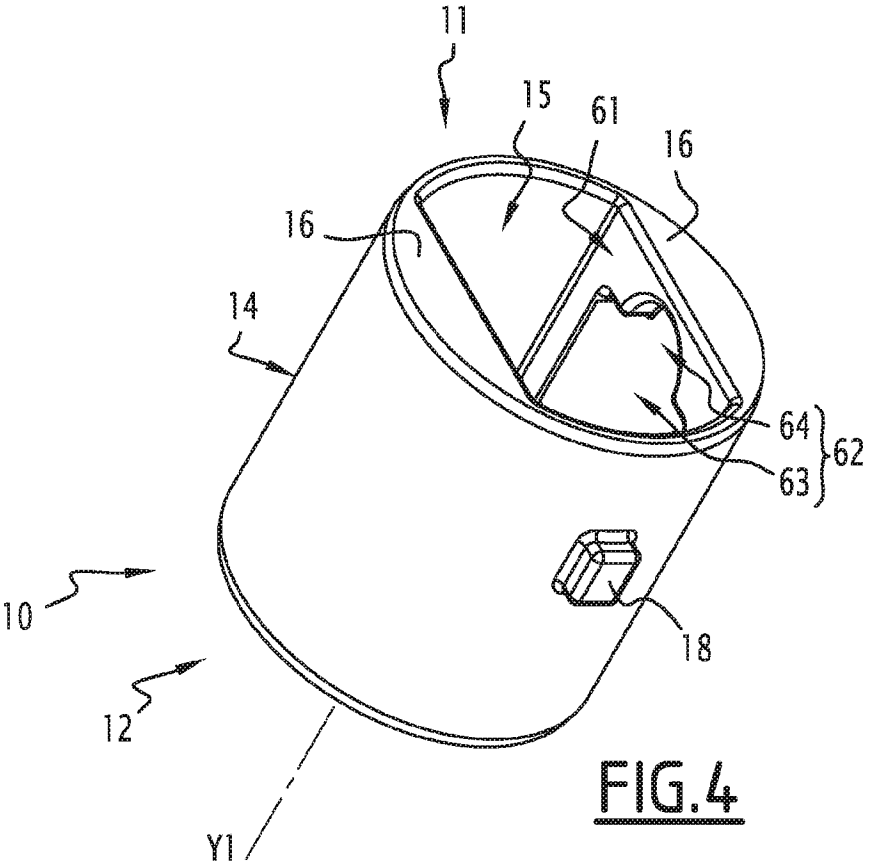
- FIG. 4 is a perspective view of the tappet.
Figure 3:
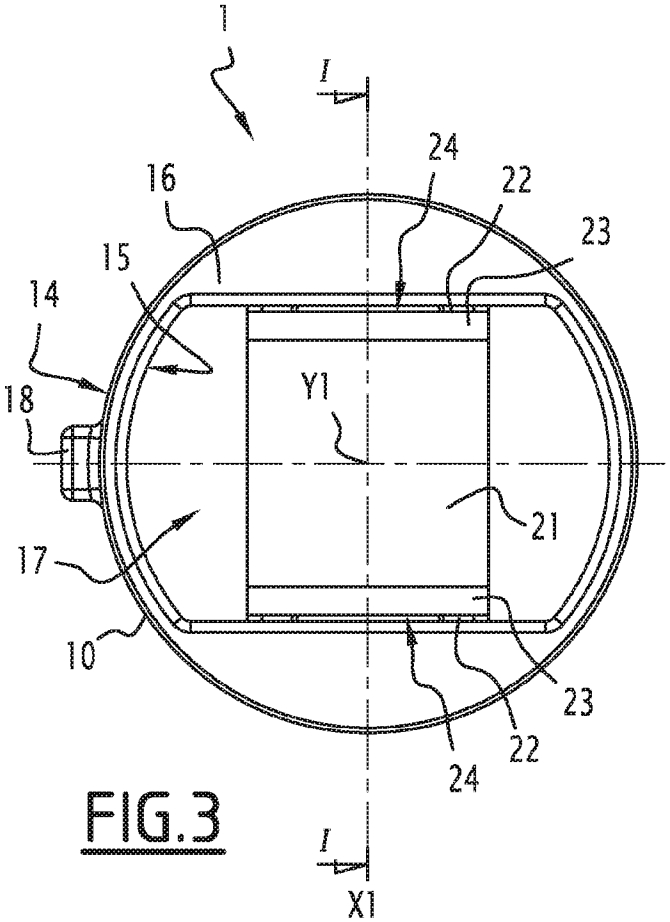
- FIG. 3 is an axial view of the cam follower along arrow III of FIG. 2, showing only the tappet and the insert.

The cam follower 1 represented on FIGS. 1 to 4 is adapted to equip a mechanical system, for example an injection pump or a valve actuator for a motor vehicle.

The cam follower 1 comprises a tappet 10, an insert 20, a pin 30, a roller 40 and a bush 50, together forming a plain bearing. Pin 30, roller 40 and bush 50 are centered on a transverse axis X1, while tappet 10 is centered on a longitudinal axis Y1. Axes X1 and Y1 are perpendicular. The tappet 10 is mounted in a housing 2, represented only on FIG. 2 for simplification purpose, belonging to the mechanical system. Housing 2 is provided with a groove 3 extending parallel to axis Y1. Housing 2 is preferably made of metal. Tappet 10 is movable back and forth along axis Y1 in housing 2. Roller 40 is adapted to roll on a cam 4, shown only partly on FIG. 1 for simplification purpose.

Tappet 10 has an overall tubular shape centered on axis Y1. Tappet 10 extends along axis Y1 between two ends 11 and 12. Tappet 10 has a cylindrical outer surface 14 and a cylindrical inner bore 15. Tappet 10 also has two inner protruding parts 16, formed on either side of axis X1. Bore 15 and parts 16 delimit a cavity 17 open at both ends 11 and 12. Cavity 17 receives a shaft not shown through end 12, for moving tappet 10 along axis Y1. Surface 14 is adapted to slide in housing 2 surrounding tappet 10.

Each inner protruding part 16 has a plane surface 61 extending perpendicular to axis X1. A recess 62 is formed in part 16 and open at surface 61. Recess 62 includes a parallelepiped section 63 and a half-cylindrical section 64 in communication with each other. Sections 63 and 64 are open toward end 12 of tappet 10. Sections 64 are centered on axis X1.

Tappet 10 is further provided with an outer pin 18 protruding from surface 14 and positioned in groove 3 of housing 2. This, pin 18 forms an anti-rotation device preventing tappet 10 from rotating in housing 2 around axis Y1.

Insert 20 comprises a plane central portion 21 and two plane lateral portions 22. Insert 20 comprises curved portions 23 connecting portions 21 and 22. Portions 22 form two lateral flanges extending parallel to axis Y1 in a bifurcated manner, from portion 21 toward end 11, on both side of axis Y1. Insert 20 comprises a half-cylindrical section 24 formed in each portion 22. Portions 22 are fitted in respective recesses 62, with sections 24 centered on axis X1 and open toward sections 64. Insert 20 is preferably made of stamped metal sheet, for example made of steel. Insert 20 is assembled with tappet 10 by insertion from end 12 and force-fitting in recesses 62.

Thanks to insert 20, the shape of tappet 10 can be simplified in comparison with a tappet supporting a pin 30, without support element. Moreover, tappet 10 and insert 20 can each be made of specific materials, chosen for specific conditions of operation. Thus, lifetime of cam follower 1 can be improved.

Pin 30 has a cylindrical outer surface 32 extending between two pin ends 34. Roller 40 has an inner cylindrical bore 41 and an outer cylindrical surface 42 extending between two lateral faces 44. Bush 50 has an inner cylindrical bore 51 and an outer cylindrical surface 52 extending between two lateral faces 54. Surface 32 of pin 30 is adjusted with bore 51 of bush 50, while surface 52 of bush 50 is adjusted with bore 41 of roller 40.

During assembly of cam follower 1, each end 34 of pin 30 is received in a bore centered on axis X1 and formed by sections 24 and 64. Pin, roller and bush axes merge with axis X1. Roller 40 is then adapted to roll on cam 4, more precisely surface 42 can roll on the outer surface of cam 4, while can follower 1 moves back and forth along axis Y1. When roller 40 rolls on cam 4, each section 26 bears a respective end 36 of pin 30, on which roller 40 is mounted. In other words, insert 20 forms a support element for pin 30 and roller 40.

According to the invention, tappet 10 is made of a composite material integrating at least one dry lubricant released at the cylindrical outer surface 14 when cam follower 1 is in operation. Thus, wear of tappet 10 moving back and forth in housing 2 can be reduced. Consequently, lifetime of cam follower 1 can be improved. The composite material of tappet 10 can be chosen as a compromise between weight, cost, resistance (to oil flow and temperature variations) and lubrication properties.

Preferably, tappet 10 comprises a synthetic matrix, by example made of polyamide (PA), polyphtalamide (PPA), polyether-ether-ketone (PEEK) or polyaryletherketone (PAEK). Thus, weight and inertia of cam follower 1 are reduced. According to an alternate embodiment, tappet 10 can include several synthetic materials.

Still preferably, tappet 10 further comprises reinforcement fibers, by example glass fibers, carbon fibers or para-aramid synthetic fibers (known under trademark "Kevlar"). Reinforcement fibers allow conserving dimensional stability of tappet 10 under high temperatures and humidity (due to oil lubrication, but also shipping conditions).

Still preferably, the at least one dry lubricant integrated to tappet 10 is chosen among graphite (C and possibly other components), polytetrafluoroethylene (PTFE) and molybdenum disulphide (MoS2).

Still preferably, reinforcement fibers and dry lubricant(s) constitute between 28% and 32% in weight of tappet 10, in particular 30% in weight.

According to a particular embodiment, tappet 10 integrates two dry lubricants, by example graphite and PTFE.

Other non-shown embodiments can be implemented without leaving the scope of the invention.

According to a non-show embodiment, tappet 10 may comprise one or several antirotation devices 18 having various shapes and/or positions. Device 18 may be formed integral with tappet 10, for example by molding, punching or machining. Alternately, device 18 may be mounted on tappet body 10, for example by clipping. Besides, tappet 10 may be provided with two or more antirotation devices 18.

According to another non-show embodiment, bush 50 may be replaced by a rolling bearing including a series of needles or rollers distributed around axis X1 between pin 30 and roller 40.

According to another non-shown embodiment, cam follower 1 may be devoid of bearing or bush 50, so that pin 30 and roller 40 form together a plain bearing. In this case, surface 32 of pin 30 is adjusted with bore 41 of roller 40.

Whatever the embodiment, tappet 10 is made of a composite material integrating at least one dry lubricant released at the cylindrical outer surface 14 when cam follower 1 is in operation.

In addition, technical features of the different embodiments can be, in whole or part, combined with each other. Thus, the cam follower 1 and its manufacturing method can be adapted to the specific requirements of the application.

The invention claimed is:

1. A cam follower comprising:

a tappet having a cylindrical outer surface centered on a longitudinal axis (Y1) and adapted to slide in a housing surrounding the tappet, the tappet having first and second longitudinal ends, the first longitudinal end being configured to receive a shaft therein such that the shaft drives the tappet along the longitudinal axis, the second longitudinal end of the tappet being partially closed by opposed inner protruding parts, the opposed inner protruding parts defining a cavity, the tappet further defining a half-cylindrical section which opens toward the first longitudinal end of the tappet, the half-cylindrical section being overlapped by the opposed inner protruding parts, a pin extending between two opposite pin ends along a transverse axis (X1) perpendicular to the longitudinal axis (Y1), each of the two opposite pin ends is mounted within the half-cylindrical section of the tappet, and a support element having a second half-cylindrical section opening toward the second longitudinal end, the support element being mounted in the tappet and supporting the pin such that each of the two opposite pin ends is sandwiched between the half-cylindrical section of the tappet and the second half-cylindrical section of the support element, wherein the cylindrical outer surface, the support element, and the opposed inner protruding parts combine to enclose the two opposite pin ends, a roller element partially protruding through the cavity in the second longitudinal end of the tappet and movable in rotation relative to the pin around the transverse axis (X1) and adapted to roll on a cam, and wherein the tappet is made of a composite material integrating at least one dry lubricant released at the cylindrical outer surface when the cam follower is in operation.

2. The cam follower according to claim 1, wherein the tappet comprises a synthetic matrix, for example made from at least one of a polyamide, polyphtalamide, polyether-ether-ketone and a polyaryletherketone.

3. The cam follower according to claim 1, wherein the tappet further comprises reinforcement fibers that include at least one of glass fibers, carbon fibers and para-aramid synthetic fibers.

4. The cam follower according to claim 3, wherein the reinforcement fibers and the at least one dry lubricant constitute between 28 and 32% in weight of the tappet.

5. The cam follower according to claim 1, wherein the at least one dry lubricant integrated to the tappet is comprised by at least one of a graphite, polytetrafluoroethylene and molybdenum disulphide.

6. The cam follower according to claim 1, wherein the tappet is made of a composite material integrating two dry lubricants, and wherein the dry lubricants are graphite and polytetrafluoroethylene.

7. The cam follower according to claim 1, further comprising at least one antirotation device for preventing rotation of the tappet in the housing around the longitudinal axis (Y1).

8. The cam follower according to claim 1, wherein the support element is fitted in recesses formed in the tappet.

9. The cam follower according to claim 1, wherein the support element is a metal insert made of steel.

10. The cam follower according to claim 1, further comprising a bearing disposed between the pin and the roller element.

* * * * *